US005379835A

United States Patent [19]

Streich

[11] Patent Number: 5,379,835

[45] Date of Patent: Jan. 10, 1995

[54] CASING CEMENTING EQUIPMENT

[75] Inventor: Steven G. Streich, Duncan, Okla.

[73] Assignee: Halliburton Company, Duncan, Okla.

[21] Appl. No.: 53,127

[22] Filed: Apr. 26, 1993

[51] Int. Cl.[6] ..... E21B 33/12

[52] U.S. Cl. ..... 166/181; 166/327

[58] Field of Search ..... 166/124, 192, 327, 376, 166/123, 135, 181

[56] References Cited

U.S. PATENT DOCUMENTS

| | | | |
|---|---|---|---|
| 1,904,317 | 4/1933 | Larkin | 166/327 |
| 2,854,081 | 9/1958 | Kriegel | 166/327 X |
| 3,054,453 | 9/1962 | Bonner | 166/135 X |
| 3,120,269 | 2/1964 | Evans et al. . | |
| 3,163,225 | 12/1964 | Perkins | 166/123 |
| 3,364,999 | 1/1968 | Brown et al. | 166/327 |
| 3,385,370 | 5/1968 | Knox et al. . | |
| 3,412,803 | 11/1968 | Stachowiak | 166/135 X |
| 4,595,052 | 6/1986 | Kristiansen | 166/192 X |
| 4,624,316 | 11/1986 | Baldridge et al. . | |
| 4,712,619 | 12/1987 | Stepp et al. . | |
| 4,834,184 | 5/1989 | Streich et al. | 166/376 |
| 4,901,794 | 2/1990 | Baugh et al. . | |
| 4,934,459 | 6/1990 | Baugh et al. . | |
| 5,113,940 | 5/1992 | Glaser | 166/192 X |

OTHER PUBLICATIONS

Sub-Surface Cementing Equipment; Halliburton Services Sales & Service Catalog No. 44, p. 32.

EZ Drill ® Squeeze Packers; Halliburton Sales & Service Catalog No. 44, p. 146.

*Primary Examiner*—Ramon S. Britts

*Assistant Examiner*—Frank S. Tsay

*Attorney, Agent, or Firm*—James R. Duzan; Stephen R. Christian

[57] ABSTRACT

Insert type floating equipment valves for use in the cementing of casing in oil and gas wells and the like which may be retained in the casing therein through the use of slips or set screws or anchors and uses either cup type or compression type sealing members.

14 Claims, 7 Drawing Sheets

CASING CEMENTING EQUIPMENT

BACKGROUND OF THE INVENTION

This invention is related to insert type casing cementing equipment for use in the cementing of the casing in oil and gas wells and the like.

When cementing casing into a well bore in oil and gas wells and the like, commonly the casing equipment used in the well cementing operations has been attached to the casing by the use of either threads or welding of both. However, these types of attachments are used when the casing equipment is attached at the end of the casing string or at a connection between two strings of casing.

Also, problems arise when trying to provide casing equipment with compatible threads to that of the casing string since there are many different types of threads and thread manufacturers. Similarly, problems arise when trying to employ welding to secure the casing equipment to the casing string. For instance, the quality of the weld cannot be predicted because, in many instances, the metallurgical composition of the casing is unknown. Additionally, due to the localized heating of the casing during welding operations of the casing equipment to the casing stress concentrations will likely be present.

Typical prior art insert type casing equipment is shown in U.S. Pat. Nos. 3,120,269, 4,901,794, and 4,934,459.

The insert type casing cementing equipment shown in the '269 Evans et al. patent utilizes an elastomeric compression type sealing member.

The insert type casing shown in the '794 and '459 Baugh et al patents utilize a deformable metal seal having a grit like gripping surface as a compression type sealing member and a back-up annular elastomeric sealing member.

The prior art insert type equipment is set in the casing by causing relative motion between portions of the equipment to cause the compression type sealing members to engage the interior of the casing.

SUMMARY OF THE INVENTION

The present invention relates to insert type casing cementing equipment for use in the cementing of the casing in oil and gas wells and the like. More specifically, the present invention relates to insert type floating equipment valves for use in the cementing of casing in oil and gas wells and the like which may be retained in the casing therein through the use of slips or set screws and uses either cup type or compression type sealing members.

BRIEF DESCRIPTION OF THE DRAWINGS

FIG. 6 is a cross-sectional view of a sixth embodiment of the present invention.

The present invention will be better understood when the drawings are taken in conjunction with the detailed description of the invention hereafter.

DESCRIPTION OF THE INVENTION

Figure 1:
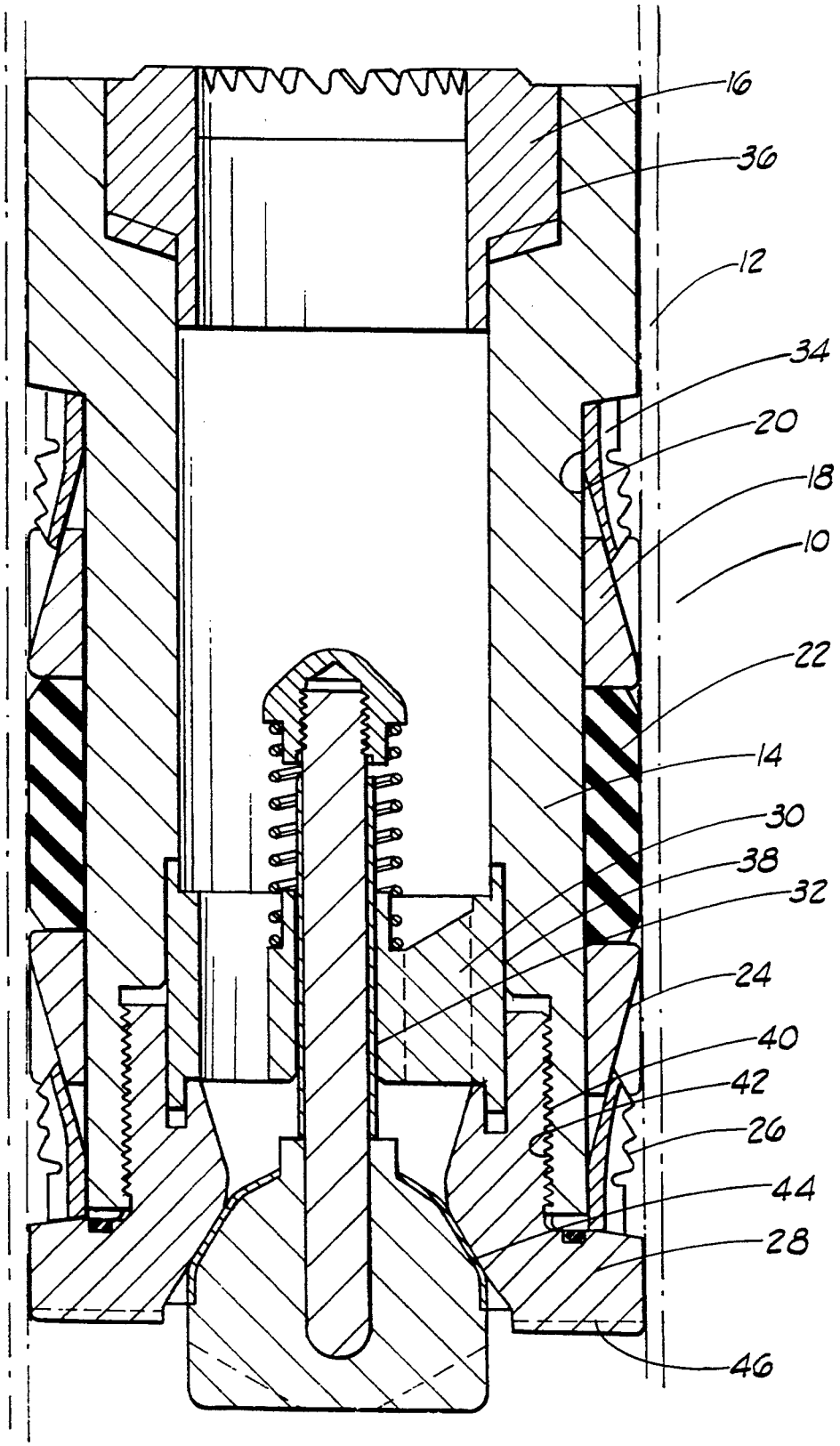
FIG. 1 is a cross-sectional view of one embodiment of the present invention.

Referring to drawing FIG. 1, a first embodiment of an insert packer type floating equipment valve 10 of the present invention is shown installed within a portion of casing 12.

The packer type floating equipment valve 10 includes an annular body 14, toothed insert 16, upper slip wedge 18, upper slips 20, compression type elastomeric packer element 22, lower slip wedge 24, lower slips 26, valve seat 28, valve poppet body 30 and poppet valve assembly 32.

The annular body 14 comprises an annular cylindrical member having, on the exterior, a portion 34 upon which the upper slip wedge 18, upper slips 20, packer element 22, lower slip wedge 24 and lower slips 26 are retained and, on the interior, upper recess 36 in which the insert 16 is retained, valve poppet body recess 38 in which a portion of the valve poppet body 30 is retained, and lower threaded recess 40 in which the valve seat 28 is threadedly retained.

The slip, slip wedge and compression set type packer element design is similar to the design for the EZ Drill® squeeze packer as illustrated on page 146 of Halliburton Services Sales and Service Catalog Number 44.

The valve poppet body 30 and poppet valve assembly 32 is similar in design to that shown and described in U.S. Pat. No. 4,712,619 and on page 32 of Halliburton Services Sales & Service Catalog Number 44.

The valve seat 28 comprises an annular cylindrical member having a threaded exterior portion 42 which threadedly engages threaded recess 40 of annular body 14, poppet valve seat surface 44 which provides the sealing surface for poppet valve assembly 32 and a plurality of jack recesses 46 in the end thereof.

Figure 2:
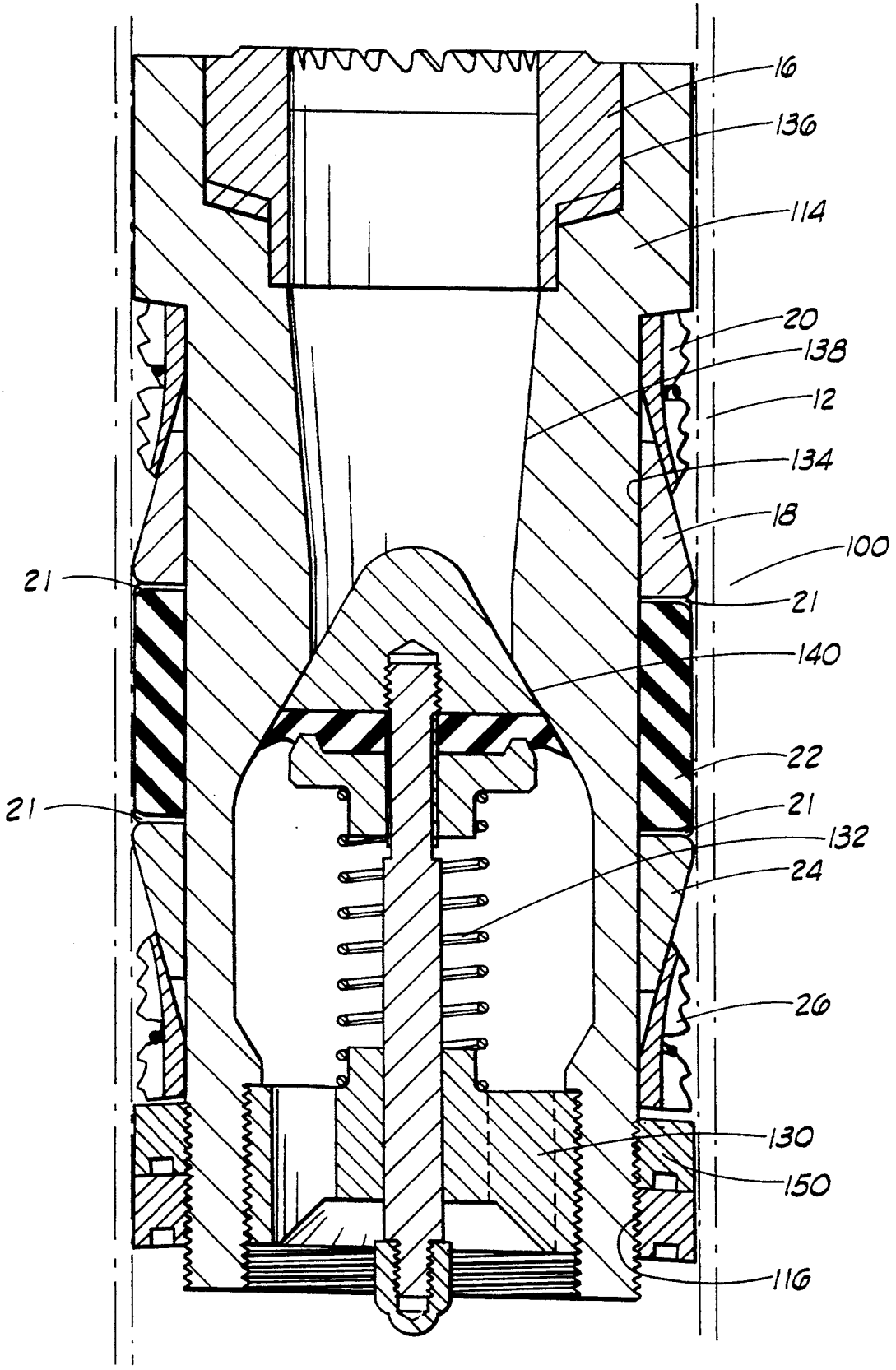
FIG. 2 is a cross-sectional view of a second embodiment of the present invention.

Referring to drawing FIG. 2, a second embodiment of an insert packer type floating equipment valve 100 of the present invention is shown installed within a portion of casing 12.

The packer type floating equipment valve 100 includes an annular body 114, toothed insert 16, upper slip wedge 18, upper slips 20, compression type elastomeric packer element 22 having brass back up members 21 associated therewith, lower slip wedge 24, lower slips 26, poppet valve body 130, poppet valve assembly 132, and threaded lock rings 150.

The annular body 114 comprises an annular cylindrical member having, on the exterior, a portion 134 upon which upper slips 20, packer element 22, lower slip wedge 24 and lower slips 26 are retained and threaded surface 116 and, on the interior, upper recess 136 in which the insert 16 is retained, annular frusto-conical poppet seat portion 140 of bore 138 and threaded bore 142 in which poppet valve body 130 is retained.

The poppet valve body 130 is similar in design to that of poppet valve body 30 in FIG. 1 and poppet valve assembly 132 is similar in design to that shown and described in U.S. Pat. No. 4,624,316.

The threaded lock rings 150 each comprise an annular cylindrical member having threaded bore 152 which threadedly engages threaded surface 116 of annular body 114.

Figure 3:
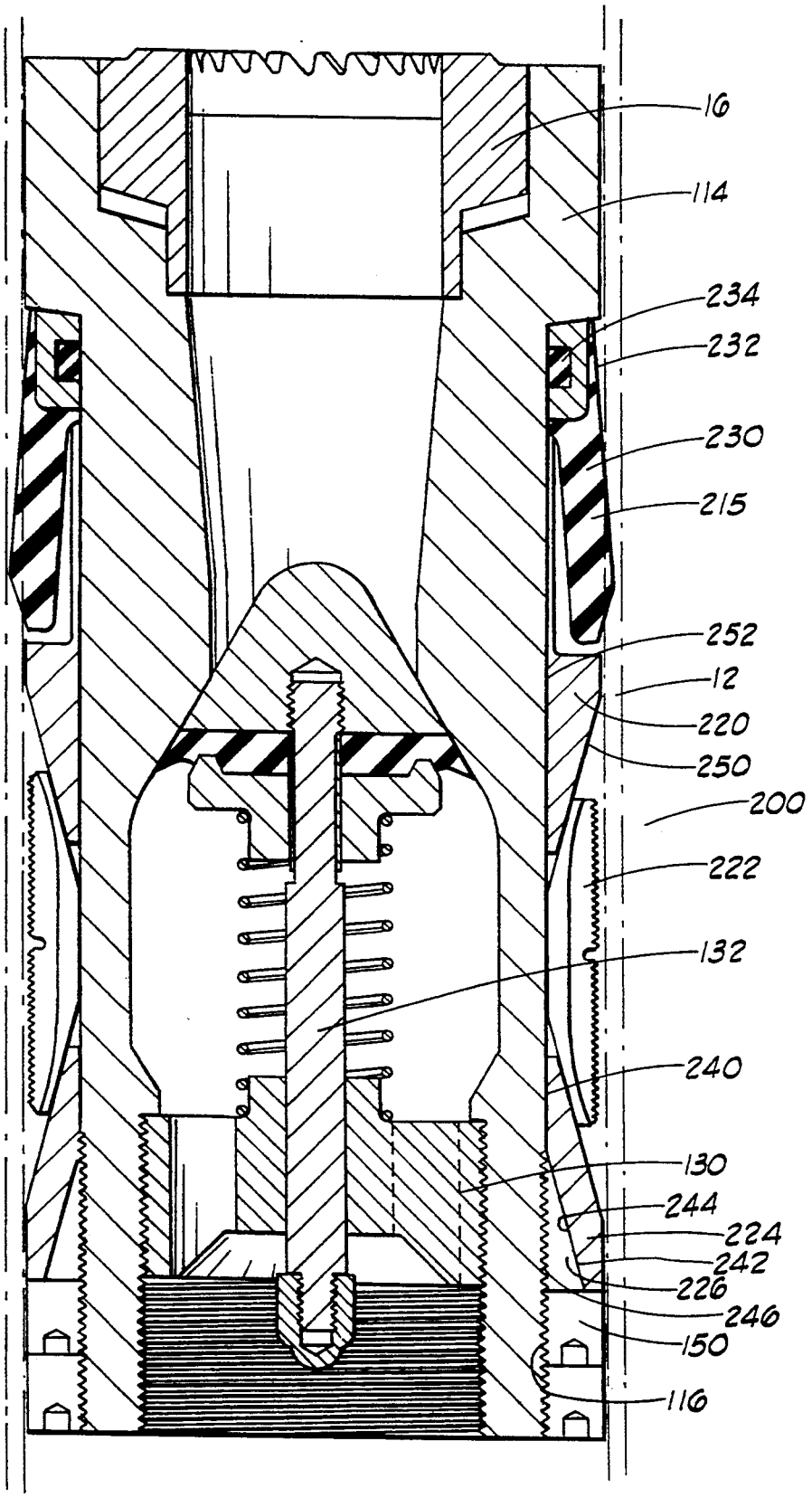
FIG. 3 is a cross-sectional view of a third embodiment of the present invention.

Referring to drawing FIG. 3, a third embodiment of a cup type seal insert type floating equipment valve 200 of the present invention is shown installed within a portion of casing 12.

The cup type seal floating equipment valve 200 includes annular body 114, toothed insert 16, elastomeric seal cup 218, upper slip wedge 220, slips 222, ratchet housing 224, ratchet 226, threaded lock rings 150, poppet valve body 130 and poppet valve assembly 132.

The elastomeric seal cup 218 comprises an annular elastomeric seal cup 230 secured to annular reinforcing member 232 having, in turn, annular elastomeric seal ring 234 retained therein sealingly engaging a portion of the exterior surface of annular member 114.

The ratchet housing 224 comprises an annular cylindrical member having a frusto-conical exterior surface and cylindrical bore 240 and frusto-conical annular bore 242 therein.

Ratchet 226 comprises an annular segmented cylindrical member 226 having frusto-conical annular surface 244 and ratchet bore 246 therein to engage threaded exterior surface 116 of annular member 114.

The upper slip wedge 220 comprises an annular cylindrical member having frusto-conical exterior surface 250 thereon and bore 252 therethrough.

Figure 4:
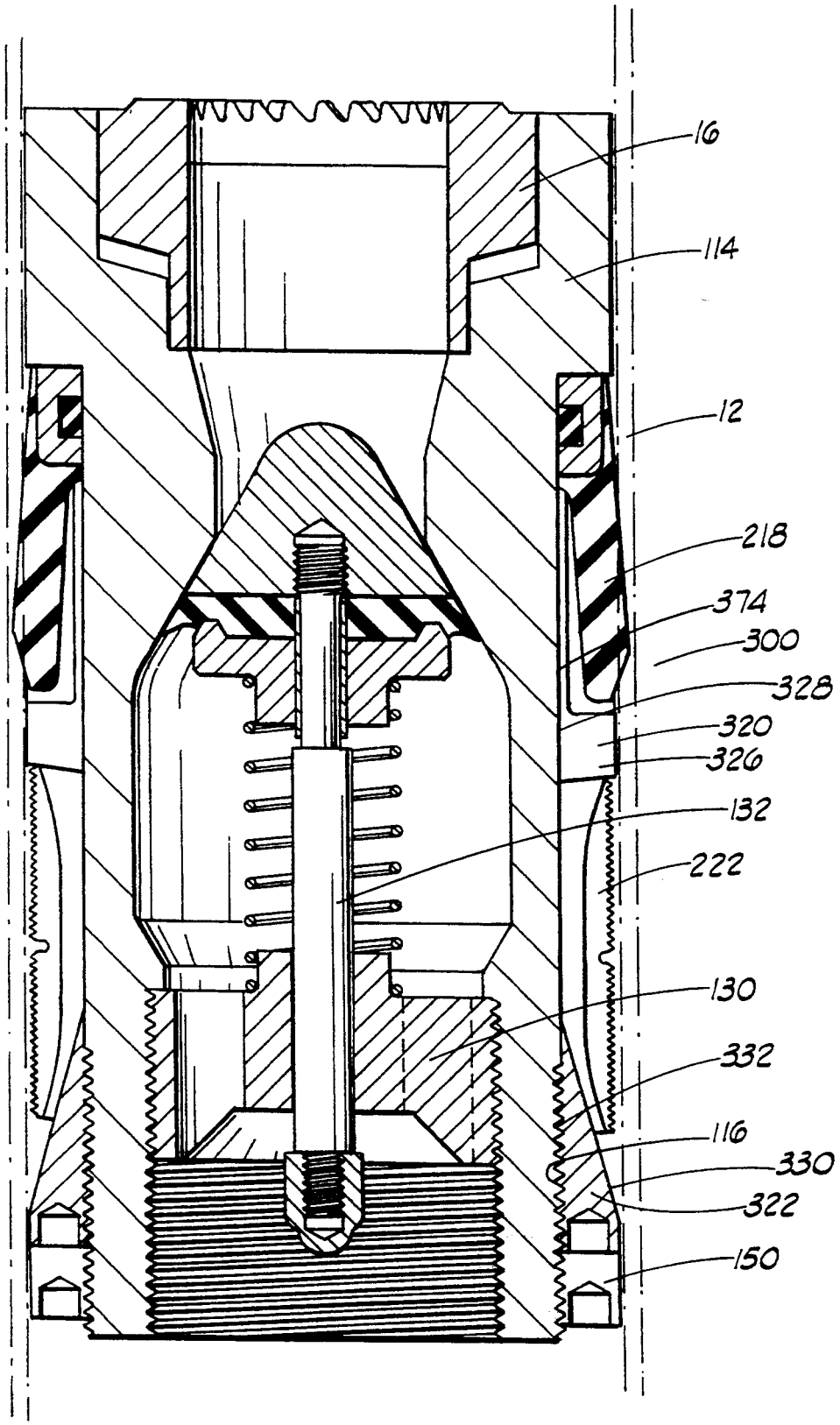
FIG. 4 is a cross-sectional view of a fourth embodiment of the present invention.

Referring to drawing FIG. 4, a fourth embodiment of a cup type seal insert type floating equipment valve 300 of the present invention is shown installed within a portion of casing 12.

The cup type seal floating equipment valve 300 includes annular body 114, toothed insert 16, elastomeric seal cup 218, upper slip body 320, slips 222, lower threaded slip wedge 322, lock ring 150, poppet valve body 130 and poppet valve assembly 132.

The upper slip body 320 comprises an annular cylindrical member having exterior surface 324, body portion 326 which abuts an end of slips 222 and bore 328.

Lower threaded slip wedge 322 comprises an annular cylindrical member having frusto-conical exterior surface 330 and threaded bore 332 which threadedly engages threaded surface 116 of annular body 114.

Figure 5:
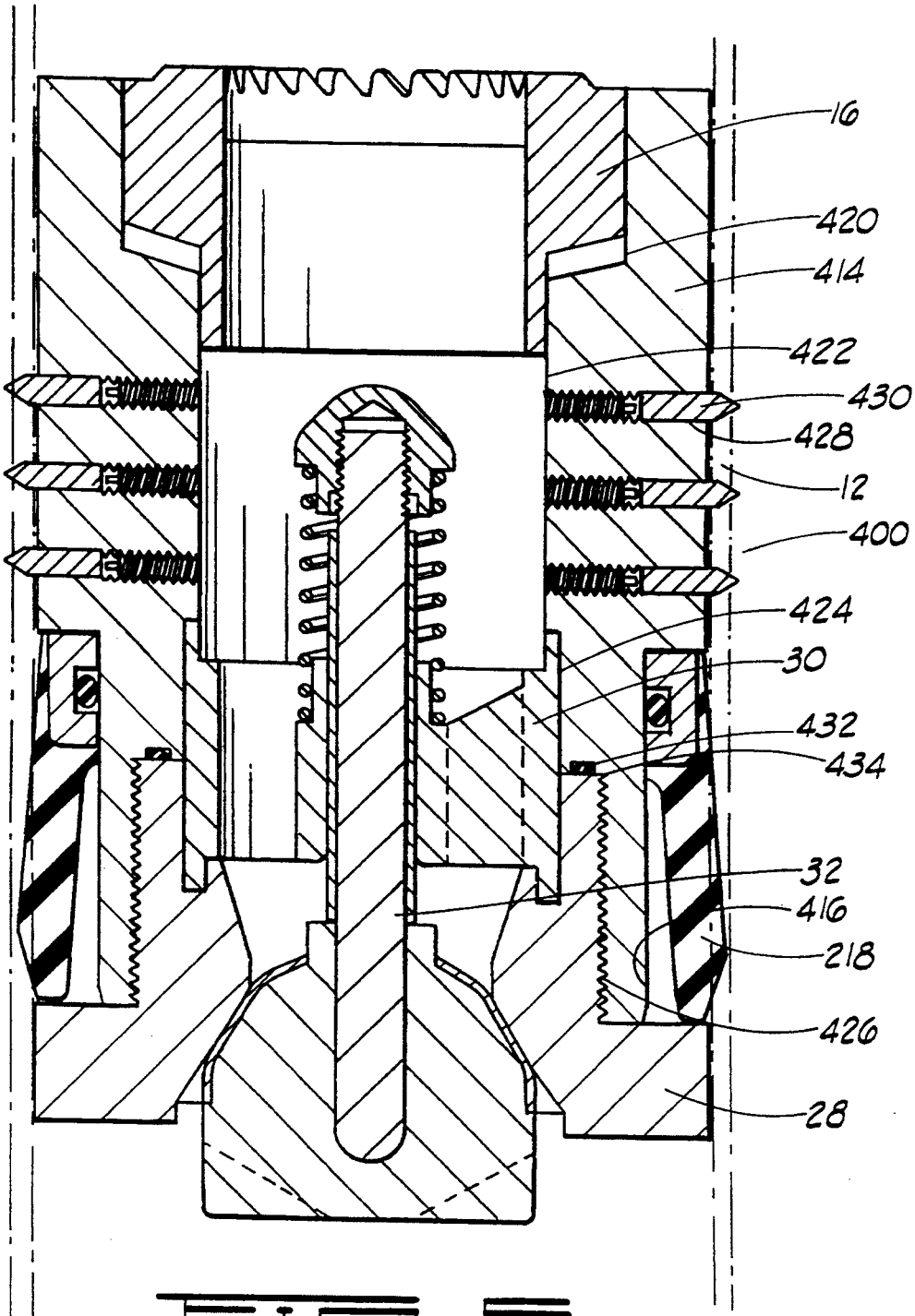
FIG. 5 is a cross-sectional view of a fifth embodiment of the present invention.
Figure 5:
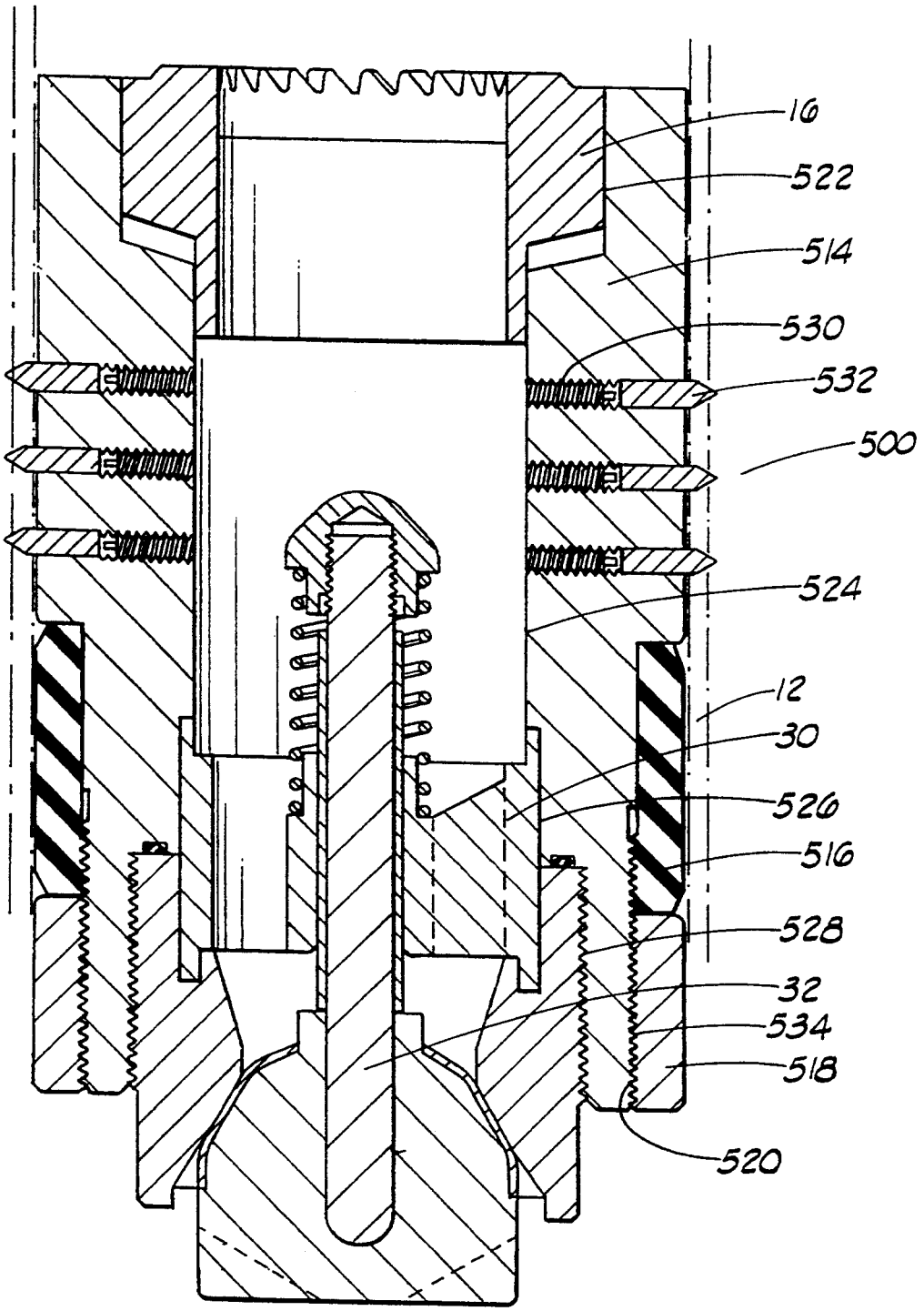

Referring to drawing FIG. 5, a fifth embodiment of a cup type seal insert type floating equipment valve 400 of the present invention is shown installed Within a portion of casing 12.

The cup type seal floating equipment valve 400 includes annular body 414, toothed insert 16, elastomeric seal cups 218, valve seat 28, poppet valve body 30 and poppet valve assembly 32.

The annular body 414 comprises an annular cylindrical member having a seal surface 416 on the exterior thereof, insert recess 420 therein, bore 422 therethrough poppet body recess 424, threaded bore 426, and a plurality of threaded apertures 428, each aperture 428 containing threaded set screw 430 therein.

The poppet valve body 30 having the poppet valve assembly 32 retained thereby is retained with poppet valve body recess 424 of annular body 414 by valve seat 28 threadedly engaging threaded bore 426 as well as sealingly engaging annular elastomeric seal 432 retained in recess 434

Referring to drawing FIG. 6, a sixth embodiment of a compression type seal insert type floating equipment valve 500 of the present invention is shown installed within a portion of casing 12.

The compression type seal floating equipment valve 500 includes annular body 514, toothed insert 16, elastomeric compression seal 516, lock ring 518, poppet valve body 30 and poppet valve assembly 32.

The annular body 514 comprises an annular cylindrical member having threaded surface 520 on the exterior thereof, insert recess 522 therein, bore 524 therethrough, poppet body recess 526, threaded bore 528, and a plurality of threaded apertures 530, each aperture 530 containing a threaded set screw 532 therein.

Lock ring 518 comprises an annular cylindrical member having a threaded bore 534 which threadedly engages threaded surface 520 of annular body 514.

OPERATION OF THE INVENTION

Figure 7:
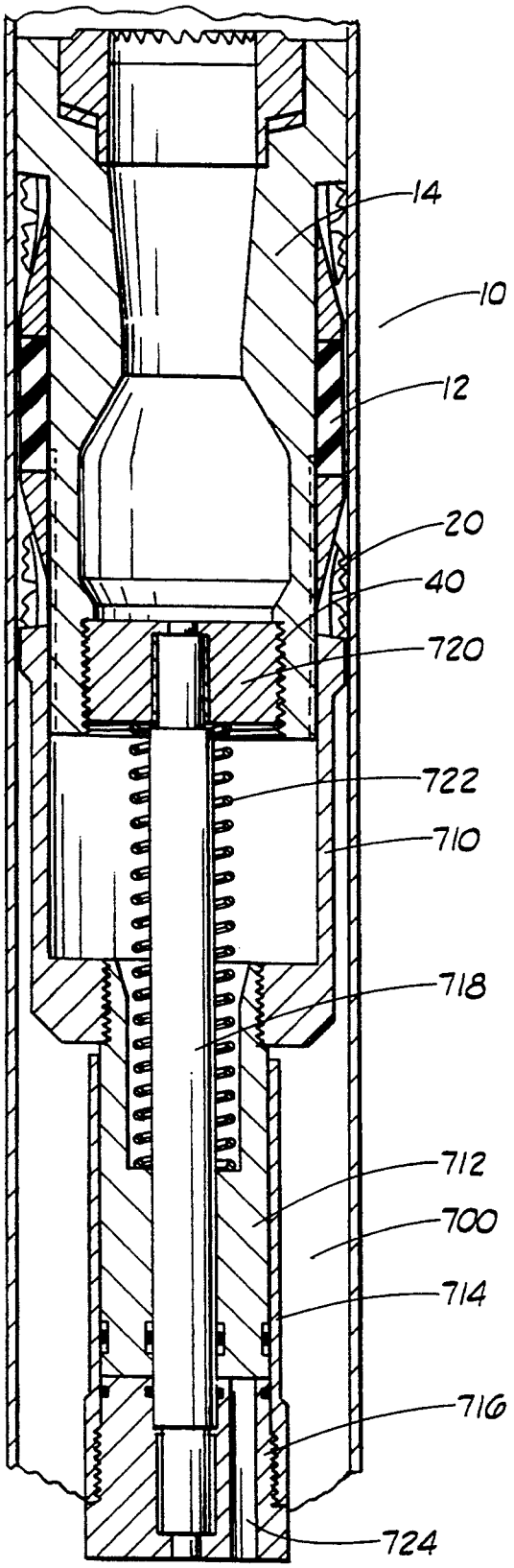
FIG. 7 is a cross-sectional view of the embodiment of the invention shown in drawing FIG. 1 being set in the casing.

Referring to drawing FIG. 7, a packer type floating equipment valve 10 is shown inserted into a piece of casing 12 at the desired location therein. The valve 10 has the valve seat 28, valve poppet body 30 and poppet valve assembly 32 removed from the valve 10 so that a hydraulic jack 700 can be secured thereto.

The jack 700 comprises a setting sleeve 710, piston 712, piston sleeve 714, plug 716, piston rod 718, connector 720 and spring 722.

The connector 720 is threaded into lower threaded recess 40 of the annular body 12 while the end of setting sleeve 710 abuts the plurality of slips 20. When fluid is pumped through port 724 of plug 716, relative movement between the piston 712 and piston rod 718 occurs to cause the setting sleeve 710 to push on the slips 20 while the piston rod 718 pulls through connector 720 to set the valve 10 in the casing 12.

After the valve 10 is set in the casing 12, the hydraulic jack 700 is removed and the poppet valve body 30, poppet valve assembly 32 and valve seat 28 are installed on the valve 10.

While the setting procedure has been described regarding the packer type floating equipment valve 10, the jack 700 can be used to set the other embodiments of the floating equipment valve of the present invention 10, 100, and 200 respectively.

Alternately, rather than using a hydraulic jack 700 a mechanical jack can be used in its place.

Referring to FIG. 4, the floating equipment valve 300 of the present invention is set by using a wrench to rotate lower threaded slip wedge 322 on annular body 114 to cause engagement of the slips 222 with the casing 12. Threaded lock ring 150 then retains threaded slip wedge 322 in position on the annular body 114.

Referring to FIG. 5 and FIG. 6, the floating equipment valves 400 and 500 are retained within the casing 12 by means of the set screws 430 and 532 respectively being screwed into engagement with the casing by use of an allen wrench or the like.

Thus, from the foregoing, it can be seen that the present invention has advantages over the prior art threaded attachment type of floating equipment.

Having thus described our invention, we claim:

1. A well tool adapted to be inserted in casing prior to said casing being run into a well bore, said well tool adapted to be inserted and retained in said casing at any desired location therein, said well tool comprising:

an annular body having a recess in one end thereof and a bore therethrough having a portion thereof forming a recess therein and a portion thereof being threaded and having a first larger exterior surface portion and a smaller second exterior surface portion, an insert secured within the recess in the one end of the annular body;

an annular upper slip wedge retained about a portion of the smaller second exterior surface portion of the annular body;

a plurality of upper slips retained about a portion of the smaller second exterior surface portion of the annular body having a portion of each slip slidably engaging a portion of the exterior of the upper slip wedge;

an elastomeric packer element retained about a portion of the smaller second exterior surface portion of the annular body, the elastomeric packer element being retained on the annular body at a location adjacent the annular upper slip wedge;

an annular lower slip wedge retained about a portion of the smaller second exterior surface portion of the annular body, the annular lower slip wedge being retained on the annular body at a location adjacent the elastomeric packer element;

a plurality of lower slips retained about a portion of the smaller second exterior surface portion of the annular body having a portion of each slip slidably engaging a portion of the exterior of the lower slip wedge;

a valve poppet body retained within the bore having a portion thereof forming recess therein of the annular body; and a poppet valve assembly being retained by a portion of the poppet valve body.

2. The well tool of claim 1 further comprising:

an annular valve seat having a bore therethrough and an exterior portion thereof releasably threadedly engaging a portion of the threaded portion of the bore of the annular body, the annular valve seat having a portion of the bore forming a valve seat to sealingly releasably engage a portion of the poppet valve assembly.

3. A well tool adapted to be inserted in casing prior to said casing being run into a well bore, said well tool adapted to be inserted and retained in said casing at any desired location therein, said tool comprising:

an annular body having a recess in one end thereof and a bore therethrough, the bore having a portion thereof forming a valve seat and having a threaded portion at the other end of the annular body and having a larger first exterior surface portion and a smaller second exterior surface portion, the smaller exterior surface portion having a portion thereof threaded;

an insert secured within the recess in the one end of the annular body;

an annular upper slip wedge retained about a portion of the smaller second exterior surface portion of the annular body;

a plurality of upper slips retained about a portion of the smaller second exterior surface portion of the annular body having a portion of each slip slidably engaging a portion of the exterior of the upper slip wedge;

an elastomeric packer element retained about a portion of the smaller second exterior surface portion of the annular body, the elastomeric packer element being installed on the annular body at a location adjacent the annular upper slip wedge;

an annular lower slip wedge retained about a portion of the smaller second exterior surface portion of the annular body, the annular lower slip wedge being retained on the annular body at a location adjacent the elastomeric packer element;

a plurality of lower slips retained about a portion of the smaller second exterior surface portion of the annular body having a portion of each slip slidably engaging a portion of the exterior of the lower slip wedge;

a annular ring threadedly retained on the threaded portion of the smaller second exterior surface portion of the annular body having a portion thereof abutting a portion of the plurality of lower slips;

a valve poppet body having a portion of the exterior thereof being threaded, the valve poppet body threadedly releasably engaging the threaded portion of the bore of the annular body; and a poppet valve assembly being retained by a portion of the poppet valve body, a portion of the poppet valve assembly releasably sealingly engaging the valve seat portion of the bore of the annular body.

4. A well tool adapted to be inserted in casing prior to said casing being run into a well bore, said well tool adapted to be inserted and retained in said casing at any desired location therein, said tool comprising:

an annular body having a recess in one end thereof and a bore therethrough, the bore having a portion thereof forming a valve seat and having a threaded portion at the other end of the annular body and having a larger first exterior surface portion and a smaller second exterior surface portion, the smaller second exterior surface portion having a portion thereof being threaded;

an insert secured within the recess in the one end of the annular body;

a cup type annular seal retained about a portion of the smaller second exterior surface portion of the annular body;

an annular upper slip wedge retained about a portion of the smaller second exterior surface portion of the annular body;

a plurality of slips retained about a portion of the smaller second exterior surface portion of the annular body having a portion of each slip slidably engaging a portion of the exterior of the upper slip wedge;

an annular ratchet housing retained about a portion of the smaller second exterior surface portion of the annular body, the annular ratchet housing having a frusto-conical exterior surface slidably engaging a portion of the plurality of slips and having a bore and a frusto-conical annular bore therethrough;

an annular ratchet member retained about a portion of the small second exterior surface portion of the annular body, the annular ratchet member having a frusto-conical exterior surface slidably engaging a portion of the frusto-conical bore the annular ratchet housing and having a threaded bore therethrough to threadedly engage the threaded portion of the smaller second exterior surface portion of the annular body;

an annular lock ring threadedly retained on the threaded portion of the smaller exterior surface portion of the annular body having a portion thereof abutting a portion of the annular ratchet member;

a valve poppet body having a portion of the exterior thereof being threaded, the valve poppet body threadedly releasably engaging the threaded portion of the bore of the annular body; and a poppet valve assembly being retained by a portion of the poppet valve body releasably sealingly engaging the valve seat portion of the bore of the annular body.

5. A well tool adapted to be inserted in casing prior to said casing being run into a well bore, said well tool adapted to be inserted and retained in said casing at any desired location therein, said tool comprising:

an annular body having a recess in one end thereof and a bore therethrough, the bore having a portion thereof forming a valve seat and having a threaded portion at the other end of the annular body and having a larger first exterior surface portion and a smaller second exterior surface portion, the smaller second exterior surface portion having a portion thereof being threaded;

an insert secured within the recess in the one end of the annular body;

a cup type annular seal retained about a portion of the smaller second exterior surface portion of the annular body;

an annular upper slip body retained about a portion of the smaller second exterior surface portion of the annular body;

a plurality of slips retained about a portion of the annular body having a portion of each slip abutting a portion of the upper slip body;

an annular lower slip wedge retained about a portion of the smaller second exterior surface portion of the annular body, the annular lower slip wedge having a frusto-conical exterior surface portion engaging a portion of each slip of the plurality of slips and having a threaded bore therethrough threadedly engaging the threaded portion of the second smaller exterior surface portion of the annular body;

an annular lock ring threadedly retained on the threaded portion of the smaller exterior surface portion of the annular body having a portion thereof abutting a portion of the annular lower slip wedge;

a valve poppet body having a portion of the exterior thereof being threaded, the valve poppet body threadedly releasably engaging the threaded portion of the bore of the annular body; and a poppet valve assembly being retained by a portion of the poppet valve body releasably sealingly engaging the valve seat portion of the bore of the annular body.

6. A well tool adapted to be inserted in casing prior to said casing being run into a well bore, said well tool adapted to be inserted and retained in said casing at any desired location therein, said well tool comprising:

an annular body having a recess in one end thereof and a bore therethrough having a portion thereof forming a recess therein and a portion thereof being threaded and having a larger first exterior surface portion and a smaller second exterior surface portion, the annular body including a plurality of threaded apertures therein, at least one aperture containing a threaded set screw therein;

an insert secured within the recess in the one end of the annular body;

a cup type annular seal retained about a portion of the smaller second exterior surface portion of the annular body;

a valve poppet body retained within the recess portion of the annular body;

a poppet valve assembly being retained by a portion of the poppet valve body; and an annular valve seat having a bore therethrough and an exterior portion thereof releasably threadedly engaging a portion of the threaded portion of the bore of the annular body, the annular valve seat having a portion of the bore forming a valve seat to sealingly releasably engage a portion of the poppet valve assembly.

7. A well tool adapted to be inserted in casing prior to said casing being run into a well bore, said well tool adapted to be inserted and retained in said casing at any desired location therein, said well tool comprising:

an annular body having a recess in one end thereof and a bore therethrough having a portion thereof forming a recess therein and a portion thereof being threaded and having a larger first exterior surface portion and a smaller second exterior surface portion having a portion thereof threaded, the annular body including a plurality of threaded apertures therein, at least one aperture containing a threaded set screw therein;

an elastomeric compression type seal element retained about a portion of the smaller second exterior surface portion of the annular body;

an annular lock ring threadedly releasably retained on the threaded portion of the second smaller exterior surface of the annular body having a portion thereof abutting the seal element;

a valve poppet body retained within the recess portion of the annular body;

a poppet valve assembly being retained by a portion of the poppet valve body; and an annular valve seat having a bore therethrough and a exterior portion thereof releasably threadedly engaging a portion of the threaded portion of the bore of the annular body, the annular valve seat having a portion of the bore forming a valve seat to sealingly releasably engage a portion of the poppet valve assembly.

8. A well tool adapted to be inserted in casing prior to said casing being run into a well bore, said well tool adapted to be inserted and retained in said casing at any desired location therein, said well tool comprising:

an annular body having a recess in one end thereof and a bore therethrough and having a larger first exterior surface portion and a smaller second exterior surface portion;

an insert secured within the recess in the one end of the annular body;

an annular seal retained about a portion of the smaller second exterior surface portion of the annular body;

a valve poppet body retained within a portion of the bore in the annular body;

a poppet valve assembly being retained by a portion of the poppet valve body;

an annular valve seat forming a part of said well tool having a portion forming a valve seat to sealingly releasably engage a portion of the poppet valve assembly; and retainer means for engaging said casing for retaining said well tool in casing.

9. The well tool of claim 8 wherein the annular seal comprises:

an elastomeric compression type seal retained about a portion of the smaller second exterior surface portion of the annular body.

10. The well tool of claim 8 wherein the annular seal comprises:

a cup type annular seal retained about a portion of the smaller second exterior surface portion of the annular body.

11. The well tool of claim 8 wherein the annular valve seat comprises:

an annular valve seat having a bore therethrough and an exterior portion thereof releasably threadedly engaging a portion of the bore of the annular body, the annular valve seat having a portion of the bore forming a valve seat to sealingly releasably engage a portion of the poppet valve assembly.

12. The well tool of claim 8 wherein the annular valve seat is formed within a portion of the bore of the annular body.

13. The well tool of claim 8 wherein the retainer means include:

a plurality of threaded set screws, each screw retained within a threaded aperture in the annular body.

14. The well tool of claim 8 wherein the retainer means include:

a plurality of slips retained about a portion of the smaller second exterior surface portion of the annular body.

* * * * *